United States Patent [19]

Blamer

[11] Patent Number: 4,461,031

[45] Date of Patent: Jul. 17, 1984

[54] TUBULAR BAG AND METHOD OF MAKING THE SAME

[75] Inventor: Robert H. Blamer, Westmont, Ill.

[73] Assignee: Bagcraft Corporation of America, Chicago, Ill.

[21] Appl. No.: 242,267

[22] Filed: Mar. 10, 1981

[51] Int. Cl.[3] ..... B65D 33/22

[52] U.S. Cl. ..... 383/123; 383/3; 383/113; 426/113

[58] Field of Search ..... 229/57, 62, 3.5 R, 87 F; 426/113; 493/235

[56] References Cited

U.S. PATENT DOCUMENTS

| | | | |
|---|---|---|---|
| 2,220,874 | 11/1940 | Waters | 493/235 |
| 2,316,385 | 4/1943 | Abramson | 229/57 X |
| 2,429,505 | 10/1947 | Ashman | 493/235 X |
| 2,550,000 | 4/1951 | Brady et al. | 229/57 |
| 2,632,723 | 3/1953 | Bennett | 229/87 F X |
| 2,730,295 | 1/1956 | Bokenkroger | 229/57 |
| 3,245,607 | 4/1966 | Kelson | 229/62 |
| 3,370,405 | 2/1968 | Fesco | 229/57 X |
| 3,478,952 | 11/1969 | Perlman | 426/113 X |
| 3,526,354 | 9/1970 | Gibbs | 229/57 |
| 3,567,111 | 3/1971 | Baxter | 229/57 |
| 3,623,653 | 11/1971 | Work | 229/87 F |
| 3,973,045 | 8/1976 | Brandberg et al. | 426/113 X |
| 4,249,978 | 2/1981 | Baker | 426/113 X |

FOREIGN PATENT DOCUMENTS

| | | | |
|---|---|---|---|
| 481082 | 12/1953 | Italy | 229/62 |
| 33245 | 2/1934 | Netherlands | 229/57 |
| 807026 | 1/1959 | United Kingdom | 493/235 |

*Primary Examiner*—William Price
*Assistant Examiner*—Gary E. Elkins
*Attorney, Agent, or Firm*—Hill, Van Santen, Steadman & Simpson

[57] ABSTRACT

A tubular web has a bottom which is tightly sealed to enable pressurizing of the bag, the bottom including a first band of thermosetting glue imprinted across the length of the web at the interior of the tube. A second band and a third band of thermosetting glue are imprinted on the tube at the exterior thereof in registry with the ends of the first band and jointly extend across a rear panel. The tube has a turned up bottom defined by a fold along a line extending centrally along the imprinted bands, each portion of the thermosetting glue bands being thermally fused only to other portions of such bands in contact therewith. In one embodiment, there is a second fold along a second line spaced from the turned up bottom which defines an area between the second line and the turned up bottom, such area being joined by glue to the back panel. A back seam extends into the bottom and includes an inner layer of greaseproof paper and an outer layer of different paper, each paper glued to itself along marginal edges that are spaced apart.

3 Claims, 11 Drawing Figures

Fig. 1
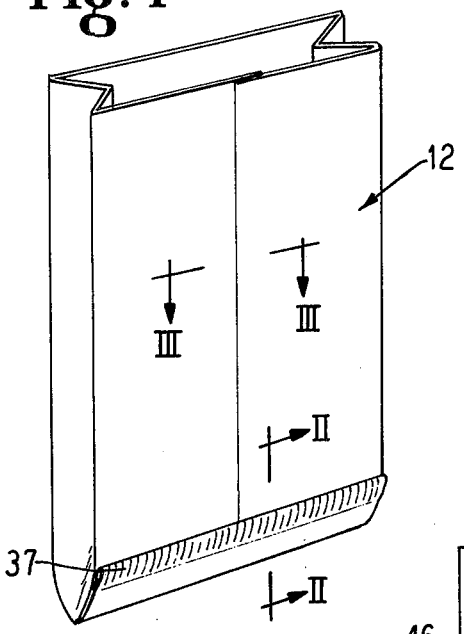
Fig. 2
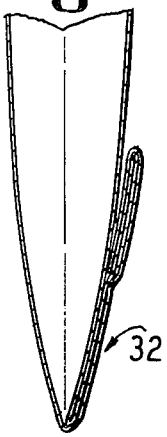
Fig. 4
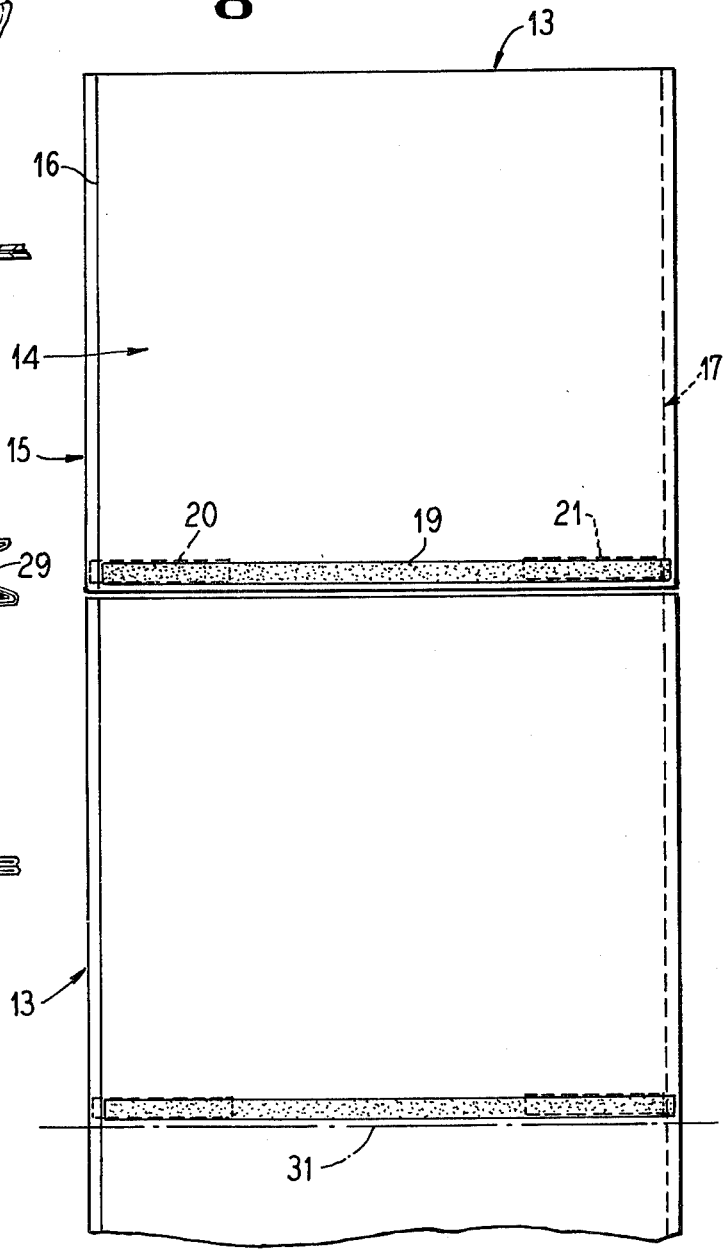
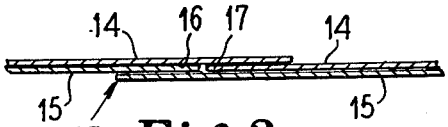
Fig. 3
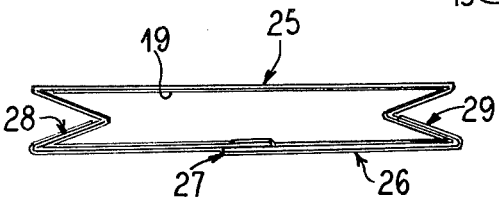
Fig. 5
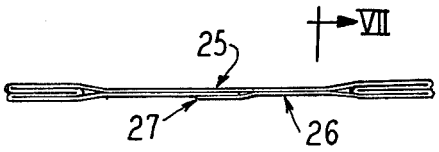
Fig. 6

Fig. 7
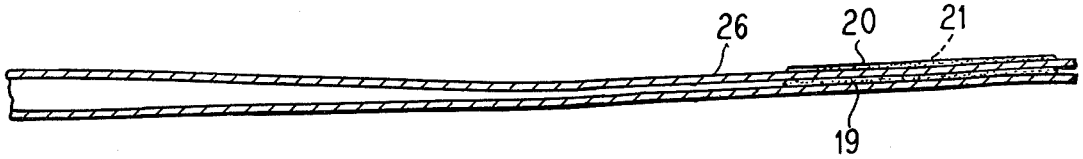
Fig. 8
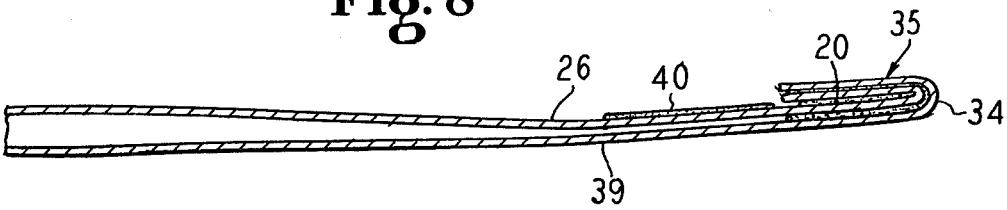
Fig. 9
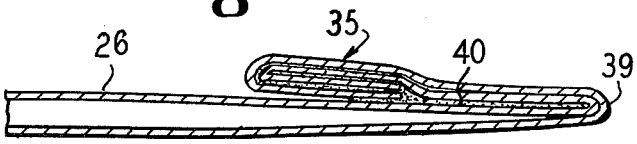
Fig. 11
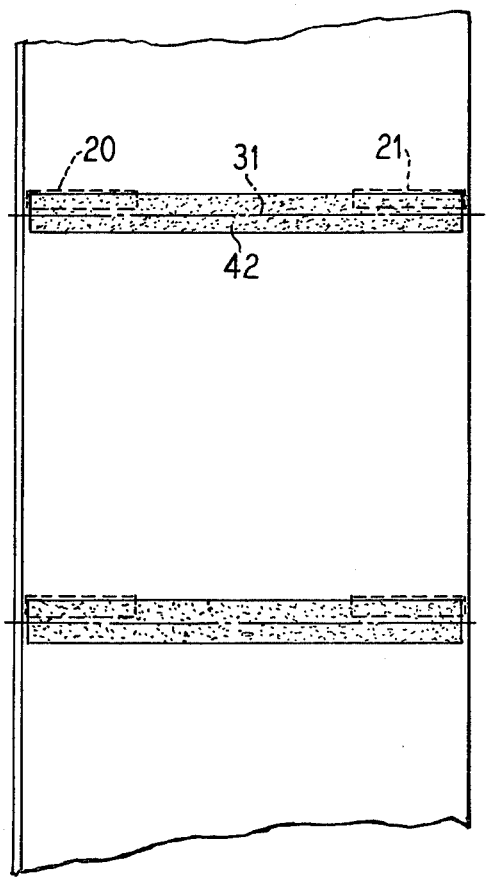
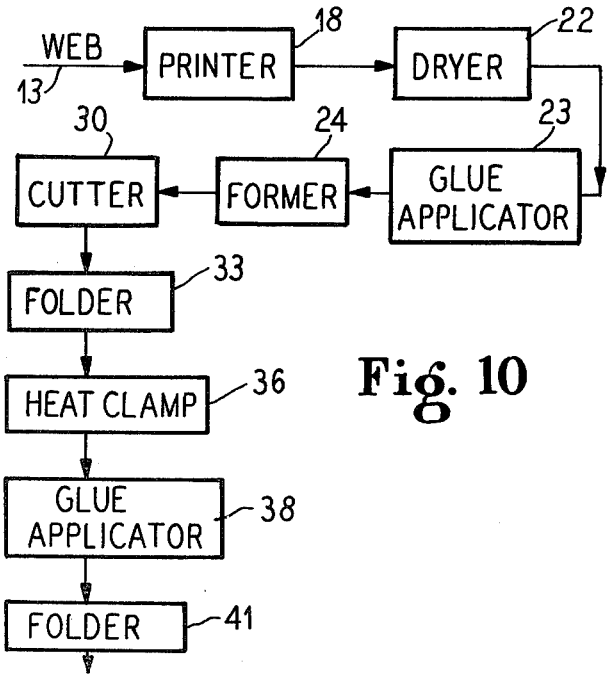
Fig. 10

TUBULAR BAG AND METHOD OF MAKING THE SAME

BACKGROUND OF THE INVENTION

1. Field of the Invention

This invention pertains to a paper bag construction of foodgrade quality.

2. Prior Art

U.S. Pat. No. 3,973,045 discloses a popcorn package for microwave popping. The assignee of the present invention is a manufacturer and supplier of bags to be filled with unpopped popcorn and shortening, and the firm that does such filling closes the mouth of the bag. When the package is placed in a microwave oven and heated, the popcorn pops and causes the bag to inflate and to develop an internal pressure. If that pressure should cause the originally closed end of the bag to leak, then melted shortening or oil can escape, and the hot gas within the package can also escape, thereby preventing some of the unpopped kernels from popping, and also soiling the interior of the oven.

SUMMARY OF THE INVENTION

The present invention is directed to a tubular bag of the type that can be used as part of a popcorn package for microwave popping.

According to another aspect of the invention, the tubular bag may be used to handle cookies and powders by providing a completely sealed closed end which is sift-proof, and wherein less paper is used for a given size bag.

An object of the invention is to provide a tubular bag having a closed bottom end, the bottom end having a strength against rupture that exceeds the rupture strength of a future closure at the mouth or upper end of the bag.

In a preferred form, a laminated paper has bands of thermosetting glue printed thereon, the printed glue being thereafter dried to a temperature below the softening temperature of the thermosetting glue. The paper is provided as a web which is then formed as a tube with the longitudinal edges joined to make a back seam. The back seam has marginal longitudinal portions recessed with the recessed portion of one layer confronting the recessed portion of the other layer so that the layer making up the inside of the bag is glued to the same kind of paper and the layer making up the outside of the bag is glued to the same kind of paper. In this manner, there are actually a pair of back seams. Increments of the tubular paper are cut off at the thermosetting glue. The bottom of the bag is then turned up along a fold line that runs centrally through the thermosetting bands of glue, after which a hot clamp which has a temperature high enough to soften the thermosetting glue, clamps the bottom end of the bag so that each portion of the thermosetting glue becomes thermally fused to the other portions of thermosetting glue that are in contact therewith. In a preferred embodiment, the fused bottom is turned up a second time along a second fold line spaced from the first turned up bottom and is glued to the outside of the bag.

Many other features of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

FIG. 1 is a perspective view of a bag made in accordance with the present invention;

FIG. 2 is an enlarged cross-sectional view taken along line II—II of FIG. 1;

FIG. 3 is an enlarged fragmentary cross-sectional view of the back seam of the bag, taken along line III—III of FIG. 1;

FIG. 4 is a plan view of a web having printing composed of thermosetting glue thereon;

FIG. 5 is a cross-sectional view of the bottom of the bag before it has been fused;

FIG. 6 corresponds to FIG. 5 with the gussets collapsed;

FIG. 7 is an enlarged cross-sectional view taken along line VII—VII of FIG. 6;

FIG. 8 corresponds to FIG. 7 after the bottom has been turned up and hot-clamped;

FIG. 9 corresponds to FIG. 8 after the bottom of the bag has been turned up a second time and joined to the back of the bag;

FIG. 10 is a diagram of the method steps used in making the bag; and

FIG. 11 is a plan view of a portion of a web with modified printing of the thermosetting glue.

AS SHOWN ON THE DRAWINGS

The principles of the present invention are particularly useful when embodied in a tubular bag such as shown in FIG. 1, generally indicated by the numeral 12. A web 13 (FIG. 4) is composed of a pair of sheets that are laminated together and sealed together over their entire surface by a water-base material. This bonding material cannot be any type of thermoplastic or other heat sealable material as that would not withstand usage in a microwave oven. The web 13 has an inner grease-proof layer 14 and an outer layer 15 of other paper provided for its strength, such as white kraft paper. The layers 14,15 are of the same width but are slightly offset to provide a recessed edge 16 in the grease-proof layer 14 and a corresponding recess 17 in the outer or other stronger layer. Thus, one layer projects beyond the other layer at one edge of the web and the other layer projects beyond the one layer at the other edge of the web.

The web 13 is fed through a printer 18 (FIG. 10), and all of the desired ink printing is applied on the side facing away from the viewer in FIG. 4. In addition, the printer applies a first band 19 of thermosetting glue across the entire length of the web on the grease-proof layer 14 near what will be the future bottom of the bag. The printer also applies a second band 20 and a third band 21 of thermosetting glue on the opposite side of the web 13 with the bands 20,21 being in registry with the ends of the band 19. The bands 20,21 are chosen to have a length so that they jointly span the back side of the bag. The printed web 13 then passes through a drier 22 which operates at a temperature below the softening temperature of the thermosetting glue. The dry printed web 13 then passes to a glue applicator 23 where glue is applied along one of the recessed edges 16 or 17 so that there is glue on both of the layers of the laminated web.

The web having the strip of glue thereon is then passed to a former 24 which imparts a tubular configuration to the web as broadly shown in FIG. 5, and which includes a front panel 25, a rear panel 26 having a back seam 27, and a pair of longitudinal gussets 28,29. The marginal recessed edges 16,17 are brought together as shown in FIG. 3. Before such folding takes place, glue is applied by the applicator 23 along either the recessed edge 16 or the recessed edge 17 of the web 13 so that the glue lies thereon along both sides of the edge 16 or 17. Thus, glue has been applied to both the inner grease-proof paper 14 and to the outer layer of other paper 15. Thus, when the edges 16,17 are brought together in confronting relation to each other, there will be glue present that bonds the inner layer 14 to the inner layer 14 and the outer layer 15 to the outer layer 15. The amount of glue applied is limited so that it does not squeeze out onto either the interior of the bag or on to the exterior of the bag. However, this construction is in reality a pair of separate back seams that extend longitudinally along each other. Thus, the back seam 27 is really a pair of back seams, one involving the joining together of the inner layers and the one nearby which joins together the outer layers.

The web 13 having been formed as a tube, it passes along to a cutter 30 which acts along a prospective line of severance 31 shown in FIG. 4 which is slightly spaced from the bands 19–21, and, therefore, there is no thermosetting glue at the mouth of the succeeding bag. Thus, in this embodiment, a longitudinal increment of the tube terminates just beyond the first band 19. The cutter 30 is one that operates without applying heat to the web, thereby avoiding any risk that the thermosetting glue might be prematurely heated.

The increment of the tube is then provided with closing means generally indicated at 32 in FIG. 2. To this end, a folder 33 turns up the bottom of the future bag along a fold line 34 which extends centrally of the bands 19–21 as shown in FIG. 8 to provide a turned up bottom 35.

A hot clamp 36 is then applied against both sides of the turned up bottom 35 which is heated and compressed, and the hot clamp 36 may also provide crimping as shown in FIG. 1 at 37. The hot clamp is of such a temperature as to soften each portion of the thermosetting glue bands, and they, therefore, fuse to the paper on which they were printed and also thermally fuse to the other portions of the bands 19–21 that are in contact therewith. In this manner, the bands 20,21 which span the rear panel 26 fuse the turned up bottom 35 against the back or rear panel 26, while the first band 19, which extends along the entire interior perimeter as shown in FIG. 5, becomes fused to itself at all the points of contact as shown in FIG. 6 (where the back seam 27 has been omitted for reasons of clarity). The entire seal formed by the band 19 actually makes two complete seals, one lying in the turned up bottom and the other lying in the adjacent portion of the front and rear panels 25,26. Thus, the structure shown in FIG. 6 actually lies in the turned up tab 35 and an identical structure to it lies in the adjacent portion of the front and rear panels.

A bag made as thus far described is one that has considerable utility in handling goods such as cookies, powders and the like in that the sealed turned up bottom 35 is stronger than conventional bags, and with the described construction, the amount of paper used to form the closing means is minimized.

However, to provide even greater strength as is preferable for the popcorn application described, a glue applicator 38 next applies glue to an area between a prospective second fold line 39 and the first turned up bottom 35. This can be done by applying the glue to either side of the prospective fold line 39, as shown in FIG. 8 at one side at 40. The bag then passes to a folder 41 which turns the bottom up a second time along the second fold line 39 which is spaced from the turned up bottom 35. As shown in FIG. 9, the glue 40 preferably flows slightly onto the turned up bottom 35 to secure the inner face thereof against the rear panel 26.

Where thermosetting glue has been referred to herein, it is applied only by printing, and once it has been heated to a softening point and permitted to harden, any future reheating does not soften the thermosetting glue. The kind of glue applied by the applicators 23,38 may have a water base but is not thermoplastic material as such a material would soften during any subsequent heating, thereby weakening the bag.

In the event that the user desires to have a bag with a thermosetting closing means at the mouth thereof, then, as shown in FIG. 11, the first band of thermosetting glue 42 is made somewhat wider than the bands 20,21 so that it spans the prospective line of severance 31. Thereafter, the cutter 30 cuts through the first band centrally along its length so that when the bag is further processed to completion as described above, a bag is provided with a closing means at its mouth of a thermosetting type for the user to complete after the user has filled the bag. To that end, if the bands 20,21 were made equal in width to the band 42, a structure would be provided which is essentially the same as that shown in FIG. 4 so that the mouth could be closed as shown in FIG. 8 or in FIG. 9.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A tubular bag adapted to be pressurized by popping corn after it has been partially filled with unpopped corn and an open end of the bag sealed, comprising:

(a) a longitudinal increment of a web of heat resistant material;

(b) a first band of thermosetting glue imprinted across the entire length of the web at the end edge of said increment on a surface that is the prospective interior of the bag;

(c) a second band and a third band of thermosetting glue imprinted on the opposite side of the web at said end edge of said increment in registry with end portions of said first band, and jointly having a length corresponding to but slightly exceeding the prospective width of the bag;

(d) said increment of web being formed as a tube with longitudinal marginal edges of the web overlapping each other and joined to form a back seam, portions intermediate said marginal edges being inwardly directed in forming a pair of longitudinal gussets disposed between a front panel and a rear panel, the rear panel including said back seam;

(e) said gussetted tube having a fold along a line extending centrally along the length of said first, second and third imprinted bands; and (f) each portion of said thermosetting glue bands being thermally fused only to other portions of said bands that are in direct contact therewith.

2. A tubular bag according to claim 1, said tube having a second fold along a second line spaced from said edge of said increment and defining an area between said second line and said end edge of said increment, said area being joined by glue to said back panel.

3. A tubular bag according to claim 2, said glue at said area also extending beneath and joining a portion beyond said end edge of said increment to said back panel.

* * * * *